US008821206B2

(12) United States Patent
Van Mil et al.

(10) Patent No.: US 8,821,206 B2
(45) Date of Patent: Sep. 2, 2014

(54) FLOTATION DEVICE

(75) Inventors: Jeroen Vincent Van Mil, Rotterdam (NL); Philip Nicolaas Bakker, Rotterdam (NL)

(73) Assignee: Van Mil Smart Innovations B.V., Rotterdam (NL)

( * ) Notice: Subject to any disclaimer, the term of this patent is extended or adjusted under 35 U.S.C. 154(b) by 0 days.

(21) Appl. No.: 12/898,023

(22) Filed: Oct. 5, 2010

(65) Prior Publication Data

US 2012/0083177 A1 Apr. 5, 2012

(51) Int. Cl.
*B63B 22/22* (2006.01)

(52) U.S. Cl.
USPC ..... 441/98; 441/31

(58) Field of Classification Search
USPC ..... 441/9, 18, 31, 98, 133; 423/269, 308
See application file for complete search history.

(56) References Cited

U.S. PATENT DOCUMENTS

| | | | | |
|---|---|---|---|---|
| 164,818 | A * | 6/1875 | Duc | 441/98 |
| 625,582 | A * | 5/1899 | Matignon | 48/2 |
| 655,373 | A * | 8/1900 | Roden | 441/98 |
| 6,767,267 | B2 * | 7/2004 | Miller | 441/123 |
| 6,974,357 | B2 * | 12/2005 | van Mil et al. | 441/98 |
| 7,322,921 | B2 * | 1/2008 | Allen et al. | 493/214 |
| 8,192,243 | B2 * | 6/2012 | Jorgensen | 441/35 |
| 2010/0323569 | A1 * | 12/2010 | Lee | 441/98 |

* cited by examiner

*Primary Examiner* — Lars A Olson
*Assistant Examiner* — Andrew Polay
(74) *Attorney, Agent, or Firm* — Nixon & Vanderhye P.C.

(57) ABSTRACT

The invention relates to a flotation device for use in retrieving an object that is dropped in water. According to the invention the flotation device comprises attachment means and a holder that is resistant in regard of spray water and atmospheric humidity. The holder comprises an inflatable body of a substantially waterproof and air-impervious material, and gas-forming reagents within the inflatable body. The inflatable body is sealed off from the rest of the interior of the holder by means of a narrow seal. In the event of activation of the flotation device, water ingresses in the holder and through the seal and comes into contact with the gas-forming reagents. The formation of gas required for the exertion of a flotation or driving force occurs within the inflatable body itself. The formed gas inflates the inflatable body.

27 Claims, 14 Drawing Sheets

FLOTATION DEVICE

FIELD OF THE INVENTION

The invention relates to a flotation device for use in retrieving an object that is dropped in water, accidentally or otherwise. The flotation device incorporates an automatically inflatable bag which will serve as a float if the object is dropped in water. In this way, retrieval of the object is facilitated.

BACKGROUND OF THE INVENTION

A flotation device of the above-mentioned type is known from—inter alia—U.S. Pat. No. 6,974,357 (Van Mil et al.). The teachings thereof are incorporated herein by reference.

In one embodiment, the known flotation device is provided with means for attaching the flotation device to a pair of spectacles that is to be retrieved, with a spray water-resistant holder that comprises a mechanism for opening the holder, which holder in its closed state encompasses an empty, inflatable body of a substantially water-permeable and air-impervious material in a folded state. The inflatable body in its uninflated state is sealed off from the rest of the interior of the holder by means of a seal comprising a water-permeable substance. The material of the inflatable body itself also comprises a water-permeable substance. The inflatable body further comprises within it one or more reagents which react under the influence of water that ingresses in the holder to form a gas, which gas serves for inflating the folded inflatable body in order to exert a flotation force on the pair of spectacles to which the flotation device of the invention is attached. In action, when an object to which the known flotation device is attached, is dropped in water, water permeates through the surface of the inflatable body. After enough water has been taken up by the material of the inflatable body, the pores of the material close and thus become substantially waterproof and impervious in regard of gas that forms as a result of the reaction of the reagents under the influence of the water within the inflatable body.

It is an object of the invention to provide for an improved flotation device of the type described in the pre-amble that is more compact and lightweight than the known flotation device.

It is also an object of the invention to provide for an improved flotation device which in action can be inflated very rapidly.

It is still another object of the invention to provide for an improved flotation device which can exert a large flotation force that is sufficient for floating large and heavy objects.

It is further another object to provide for an improved flotation device which in its un-inflated state can retain its potential working during a long period of time.

It is further yet another object to provide for an improved flotation device which in its inflated state can maintain the flotation force exerted by it during a long period of time.

It is also an object of the invention to provide for an improved flotation device which is more cost-effective to manufacture than the known flotation device.

It is also an object of the invention to provide for an improved flotation device which is more reliable in use than the known flotation device.

SUMMARY OF THE INVENTION

According to an aspect of the invention one or more of the stated objectives are achieved by a flotation device for use in retrieving an object when dropped in water, whereby the flotation device comprises:

attachment means for attaching the flotation device to the object that is to be retrieved, a spray water-resistant holder that comprises a mechanism for opening the holder, which holder in its closed state encompasses an empty, inflatable body of a substantially waterproof and air-impervious material, whereby the empty inflatable body is sealed off from the rest of the interior of the holder by means of a seal comprising a water-permeable substance, and the water-permeable substance of the seal is joined directly to the inflatable body itself, one or more reagents which react under the influence of water that ingresses in the holder to form a gas, which gas serves for filling the inflatable body in order to exert a flotation force on the object to which the flotation device is attached, whereby the gas-forming reagents are comprised within the substantially waterproof and air-impervious inflatable body itself.

A distinction in comparison with the known flotation device is that the material of the inflatable body is substantially waterproof instead of water-permeable prior to use.

An advantage is that a cheap material can be used for the inflatable body instead of a special material whose properties change from water-permeable when dry to waterproof when wet.

In a preferred embodiment, the seal comprises a single layer of a water-permeable substance sandwiched between two sections of the inflatable body.

An advantage of a single sandwich-layered seal is that it allows for easier manufacturing in comparison with manufacturing of the known flotation device. It also allows for a better manufacturing quality control. A better manufacturing quality enhances a more reliable functioning of the flotation device.

In a preferred embodiment, the seal of the inflatable body that seals off the inflatable body in its uninflated state from the rest of the interior of the holder has a narrow cross-section. Narrow is to be construed as relating to the smallest dimension of the cross-section of the seal. For a lightweight object such as a pair of spectacles, the seal may measure anywhere between 0.2 mm and 2 mm across at its narrowest cross-section. For a heavy object that weighs tens of kilograms, the seal may measure up to several centimeters across at its narrowest section.

An advantage is that a narrow seal affords a better regulation of ingress of water through it in comparison with the known flotation device in which water can ingress through any part of the inflatable body. Consequently, a better regulation of ingress of water affords a better regulation of the onset of the gas-forming reaction within the inflatable body.

Another advantage of a narrow cross-section is that the inflatable body can be rolled up tightly. As a consequence, the holder can be made quite compact, which in turn, allows for an easier attachment of the holder to an object. For example, if the object to be retrieved is a pair of spectacles, then a small flotation device can easily be attached to an arm of the pair of spectacles and it will allow for more comfort and less visual distraction for the person wearing the pair of spectacles. Preferably, the holder is made in a cylindrical form, as this form offers a favourable volume-to-surface ratio and it is not obstrusive when attached to an object. The holder may, of course, have any suitable form, e.g. that of a miniature drinks bottle, a miniature cell phone, etc.

Yet another advantage of a narrow cross-section is that the internal pressure of an inflated body can set to be high before any overpressure is released. A high internal pressure allows for a higher buoyancy force and a longer buoyancy period.

In a preferred embodiment, the seal comprising a narrow cross-section extends into the inflatable body in a direction perpendicular to the cross-section across a length that is 0.3-30 times the dimension of the seal at its narrowest cross-section.

An advantage of a long and narrow seal is that it allows for a high threshold value of the internal pressure within an inflated body to be set before the seal acts as a valve to reduce the internal pressure of the inflated body. A high internal pressure entails that more gas can be contained within the inflatable body during a longer period of time in comparison with the known flotation device. This provides for a longer buoyancy period of the inflated flotation device.

Another advantage is that the higher the internal pressure that can build up in an inflatable body before the seal acts as a valve, the greater the certainty that an inflating body can unroll or unfold when the device and a retrievable object to which it is attached have dropped in water and have come to rest against a pebble or rock or suchlike object at the bottom of a body of water.

The provision of means on the inside of the holder for keeping the inflatable body away from the axial ends of the holder also aids a proper unfolding of an inflatable body in the process of being inflated. Suitable means comprise e.g. ribs and curved surface sections at the axial ends of the holder.

Another advantage of a long and narrow seal is that it provides a high resistance to transport of mass across the seal. A high resistance impairs ingress of humid air in to the inflatable body. Ingress of humid air is unfavourable, because the reagents may lead to a premature reaction or to a reaction that may not propagate, or may lose their reactivity, etc. A long and narrow seal helps to preserve the reactivity of the reagents within the inflatable body during a long period of time.

There is a practical consideration in regard of how much resistance a long and narrow seal should provide. Too high a resistance will hinder rapid ingress of water into the inflatable body and thus delay the onset and propagation of the gas-forming reaction within the inflatable body. In a preferred embodiment, the water-permeable substance of the seal of the inflatable body is water-absorbing. The presence of water within the seal ensures that there is a continuous chain of water molecules so that ingress and throughput of water into the interior of the inflatable body and to the gas-forming reagents occurs rapidly. Once sufficient water has ingressed into the inflatable body, the gas-forming reaction starts and quickly propagates. The formation of lots of gas within a short period of time leads to a high internal pressure that subsequently bars further water from ingressing through the seal into the inflatable body. In other words, a high resistance is needed to be overcome before water can ingress into the inflatable body. Once water starts ingressing, ingress occurs quickly so that the gas-forming reaction occurs quickly. Propagation of the gas-forming reaction is very rapid and a high internal pressure builds up rapidly. The latter puts a stop to further ingress of water into the inflatable body.

Thus, for the purpose of enhancing ingress of water, in a further preferred embodiment, the water-permeable substance of the seal is a hydrophilic material. An advantage hereof is that it is only after a device according to the invention, along with the object to which it has been attached, has dropped in water, that water ingresses through the long and narrow seal into the inflatable body, and once that water has ingressed, the rate of ingress of water into the inflatable body is enhanced through the use of a hydrophilic material.

Preferably, the water-permeable seal of the substance of the inflatable body has a pre-determinable overpressure-releasing function. This offers an advantage that the flotation force and buoyancy of an inflated body that can be tailor-made for any particular object that is to be retrieved when dropped in water.

Preferably, the water-permeable seal of the substance of the inflatable body comprises a non-woven material, most preferably Sontara® by DuPont, Non-woven materials offer an advantage of readily drawing water due to a capillary action and in various cases, also absorbing water that has been drawn.

Preferably, the seal comprises a strip of non-woven material enveloped by the material of the inflatable body at one end of the inflatable body, the seal being a double heat seal formed such that the material of the inflatable body has melted on and, more preferably, also into, the absorbing non-woven material locally. This offers an advantage that the seal is mechanically robust and is able to withstand high internal pressures in the inflated body.

According to another aspect of the invention the mechanism for opening the spray water-resistant holder comprises a water-soluble foil that envelops a non-woven material which in turn encloses an inflatable body. This offers an advantage that when an attached device is dropped in water, the foil does not immediately dissolve and the holder is not exposed to water long enough so that, in the event that the device is retrieved immediately, flotation is not required. To further this end, a water-soluble foil may even be treated with a hydrophobic substance on its outside so as to ensure that any drawing in of water only occurs at its axial ends where a non-woven material is exposed to water along its circumference. If the device is not retrieved from the water immediately upon being dropped, then the non-woven material draws water so that the foil also starts dissolving from within. Since the foil is wetted by the non-woven material across the whole of its length and it starts dissolving from within, the holder is exposed to water quite quickly, water ingresses through the narrow seal and into the inflatable body quickly and the gas-forming reaction occurs as soon as possible. The foil forms a sort of roll or wrapper around the holder with a layer or lining of non-woven material in between the holder and the foil. An example of a water-soluble foil is one that comprises a polyvinylacohol. The choice of a suitable water-soluble foil can be made to account for various ambient conditions, such as a low water temperature, the degree of wetting that is required, the desired rate of bio-degradation of the foil, etc. Processes such as wetting or dissolution of an internal surface or foil comprising e.g. polyvinylalcohol also take place quickly enough when a device is dropped in water at a low temperature. It thus ensures a reliable action of the flotation device at a low water temperature.

In order to enhance the exposure of the holder to water when an attached object is dropped in water, the foil is preferably provided with a slit, a very thin gap, across at least a part of its axial length. This offers an advantage that the water absorbed by the non-woven material layered on the inside of the outer foil exerts pressure against the foil, so that the foil is helped to burst open from the inside.

In an ideal situation, the non-woven material is intended to draw in water only around the circumference at the axial ends of the holder. In order to cope with non-ideal situations as in real life, a thin slit or gap provided across at least a part of the axial length of the foil will facilitate that the layer or lining of non-woven material on the inside of the foil gets to wet across the whole breadth on the inside of the foil if and when an object lies long enough in water. In these circumstances, as a consequence, this enhances the drawing in of water by the non-woven material and the ingress of water into the holder and the inflatable body, so that rapid gas-forming can take place.

A thin slit or gap across at feast a part of the length of the foil allows for the foil to be rolled up tightly, and the holder as a consequence can be made compact.

According to another aspect of the invention the means for attaching the flotation device to an object that is to be retrieved comprise an elastic cord. An advantage is that the device can be attached securely to objects of alls sorts of shapes and sizes, in the example of a pair of spectacles, to an arm of a pair of spectacles having very narrow arms, or very wide arms, or arms with undulating forms, etc. A high degree of elasticity is important.

In an alternative embodiment, any other means of attachment can be used. An advantage is that a strongly adhesive material, which is also easily removable and preferably does not leave any trace upon removal, can be used to attach the device according to the invention to most surfaces such as metal, plastics, etc. In a preferred embodiment, double-sided mounting tape is used as the means of attachment. A very suitable type of tape e.g. is VHB® by 3M.

According to another aspect the invention also relates to a method of manufacturing a flotation device for use in retrieving an object that is dropped in water, whereby the method comprises the following steps:

- inserting a layer of non-woven material at one end of a length of open-ended tube,
- applying heat and/or pressure for melting the sides of the tube and the non-woven material together until a narrow seal is formed at said end of the tube,
- providing said length of tube with gas-forming reagents from its remaining open end,
- extracting most of the air in said length of tube, and sealing off the remaining open end of the tube to form an inflatable body,
- rolling up the length of tube in the direction of the narrow seal,
- attaching the rolled-up inflatable body to a housing or holder,
- providing a spray water-resistant foil around the housing that comprises the rolled-up inflatable body, and
- providing the assembly of the spray water-resistant foil encompassing a holder, which in turn encompasses the inflatable body comprising a narrow seal and gas-forming reagents within, with means for attachment to an object that is to be retrieved when the latter is dropped in water.

This offers the production-related advantage that the device can be produced in large numbers and at small cost.

BRIEF DESCRIPTION OF THE FIGURES

The inventive concept will now be described in detail and further embodiments will be described with reference to an example and its related drawings. The drawings depict the following.

DETAILED DESCRIPTION

Figure 1A:
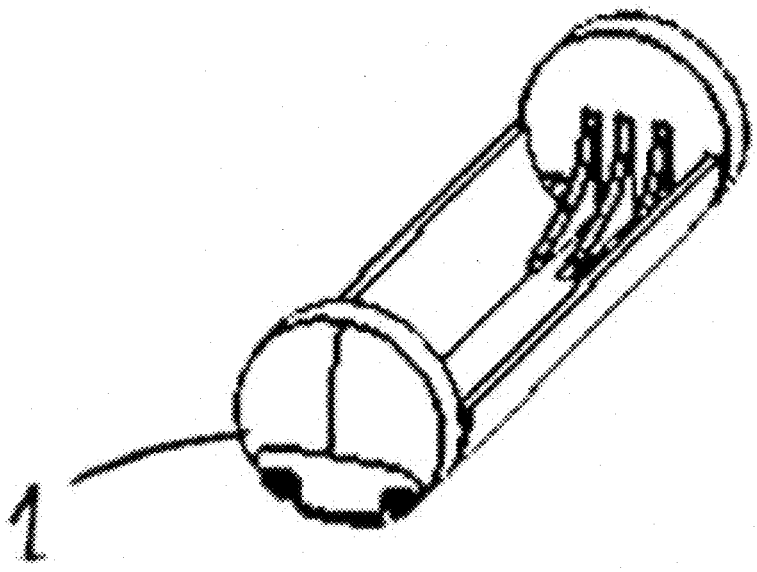
FIGS. 1A-1D show perspective views of four components that are used to assemble a flotation device according to the invention.
Figure 1B:
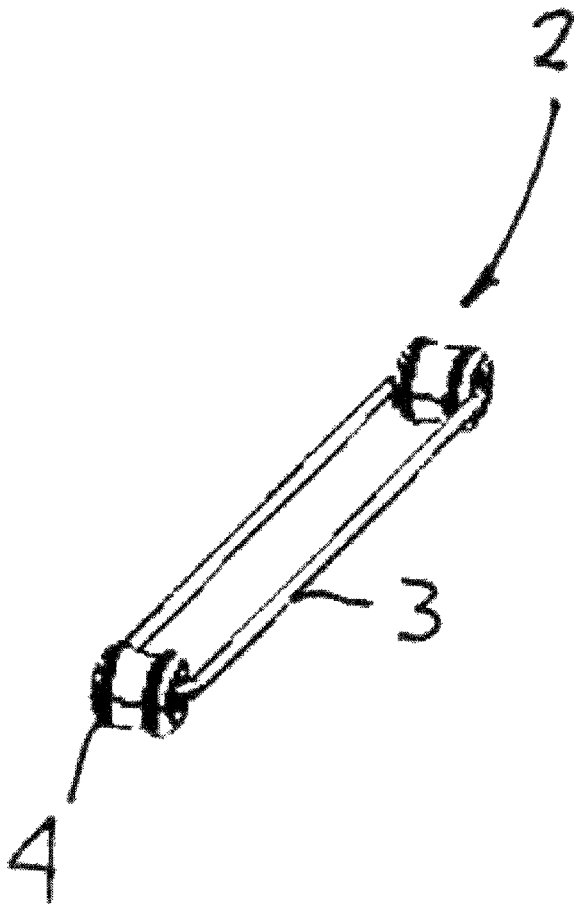
Figure 1C:
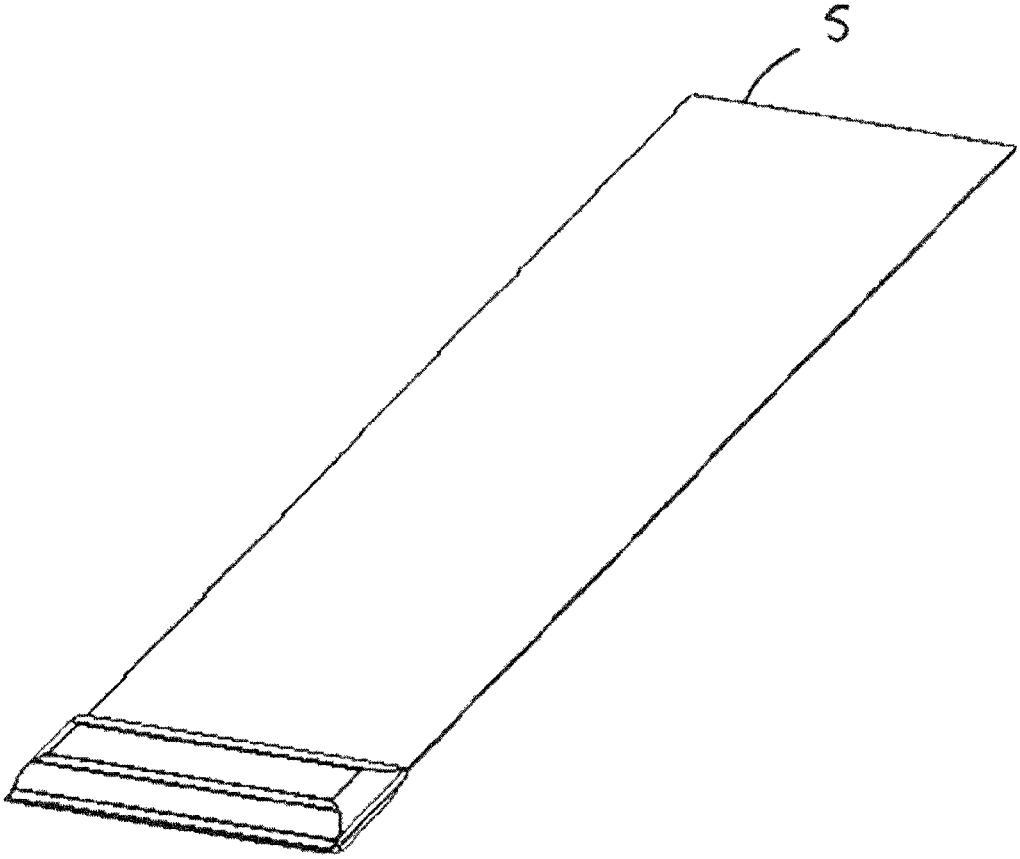
Figure 1D:
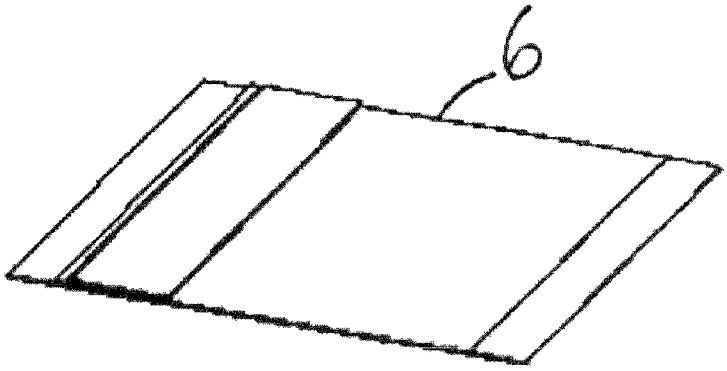

The drawings are schematic and are not drawn to scale. In the drawings the same numbers refer to corresponding parts of the depicted embodiments of the device.

There are four parts that are assembled together to form an embodiment of the flotation device according to the invention. As seen from left to right in FIGS. 1A-1D, these parts are a housing or holder 1, in this example a moulded plastic holder; attachment means 2, in this example comprising an elastic cord 3 and two beads 4; an inflatable body 5, in this example a polyethene (PE) tube; and a multi-layered outer foil 6.

Figure 2:
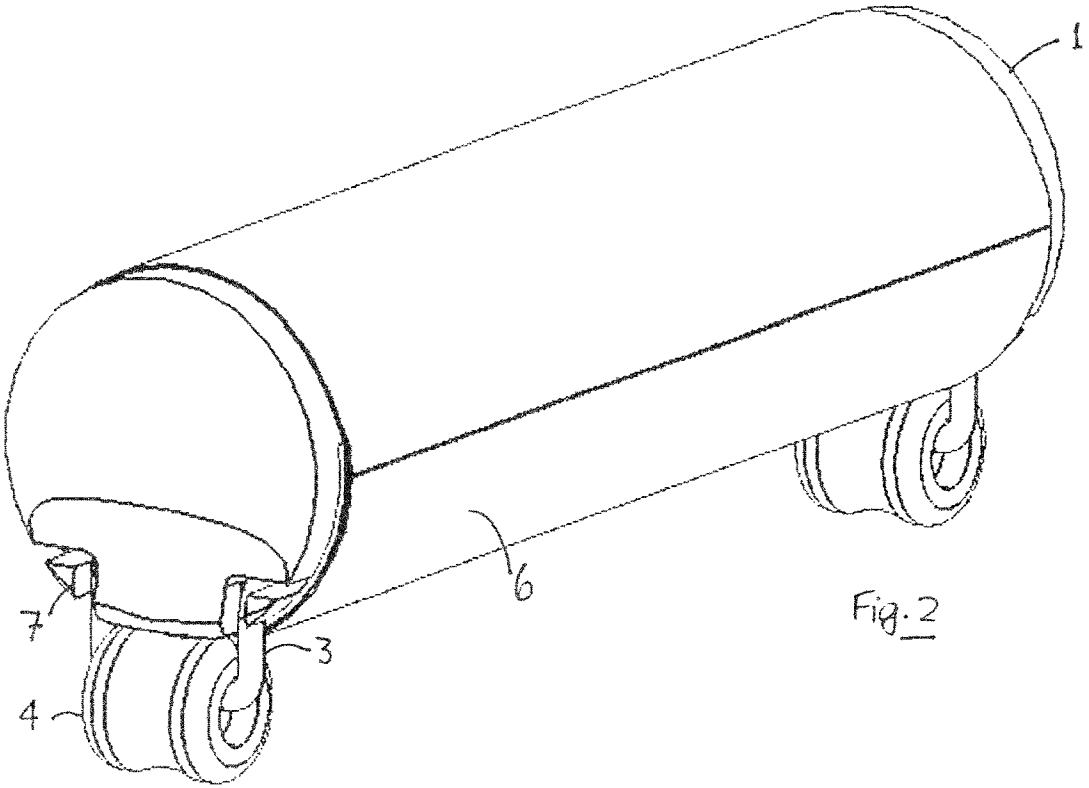
FIG. 2 shows an embodiment of the flotation device according to the invention in its assembled and ready-to-use state.

In its assembled state, as shown in FIG. 2, the flotation device has an elongate shape, in this example a substantially cylindrical shape whereby the outer foil 6 is rolled around the holder 1. The outer foil also encompasses the elastic cord 3 that runs along the axial length on the inside of the holder. The elastic cord is kept in place by running it through guide notches 7 provided at the longitudinal ends of the holder 1.

Figure 3A:
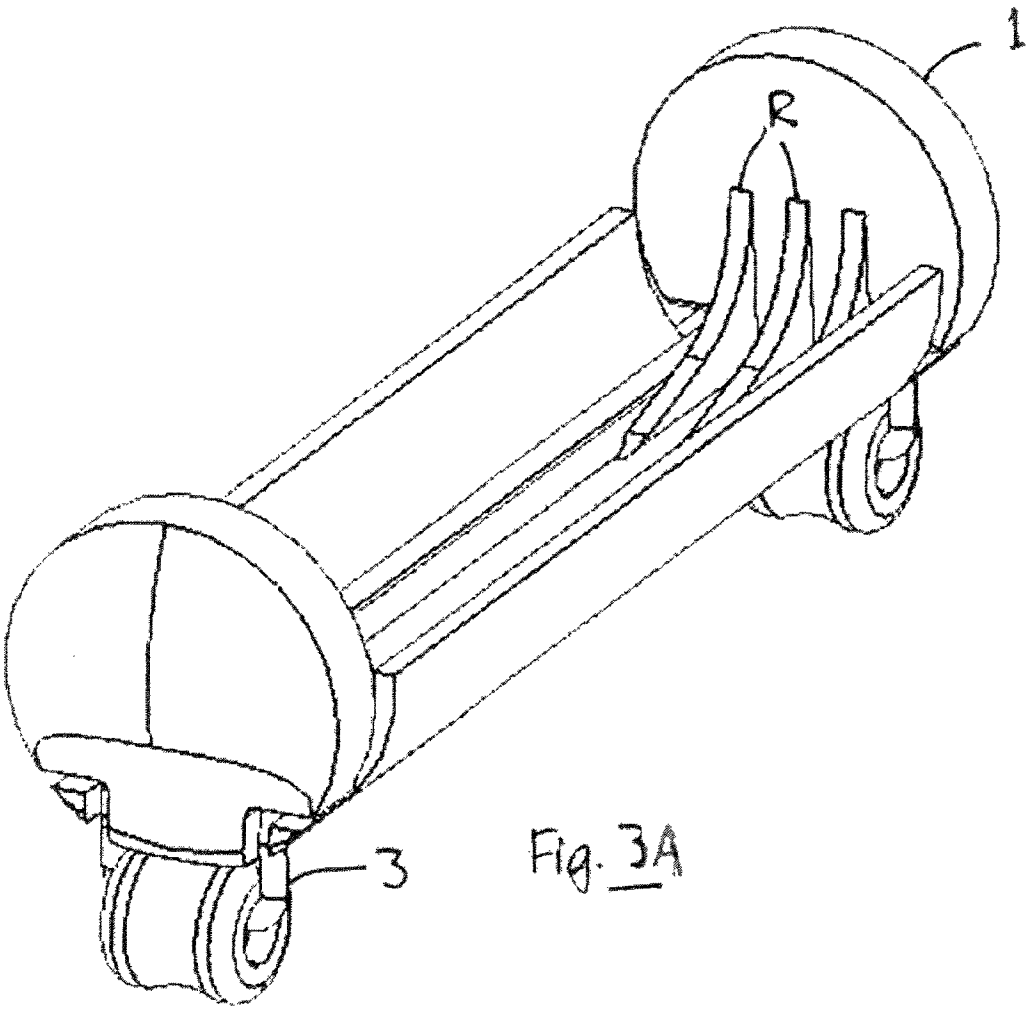
FIGS. 3A-3B show a perspective view of an empty housing and a housing encompassing an inflatable body.
Figure 3B:
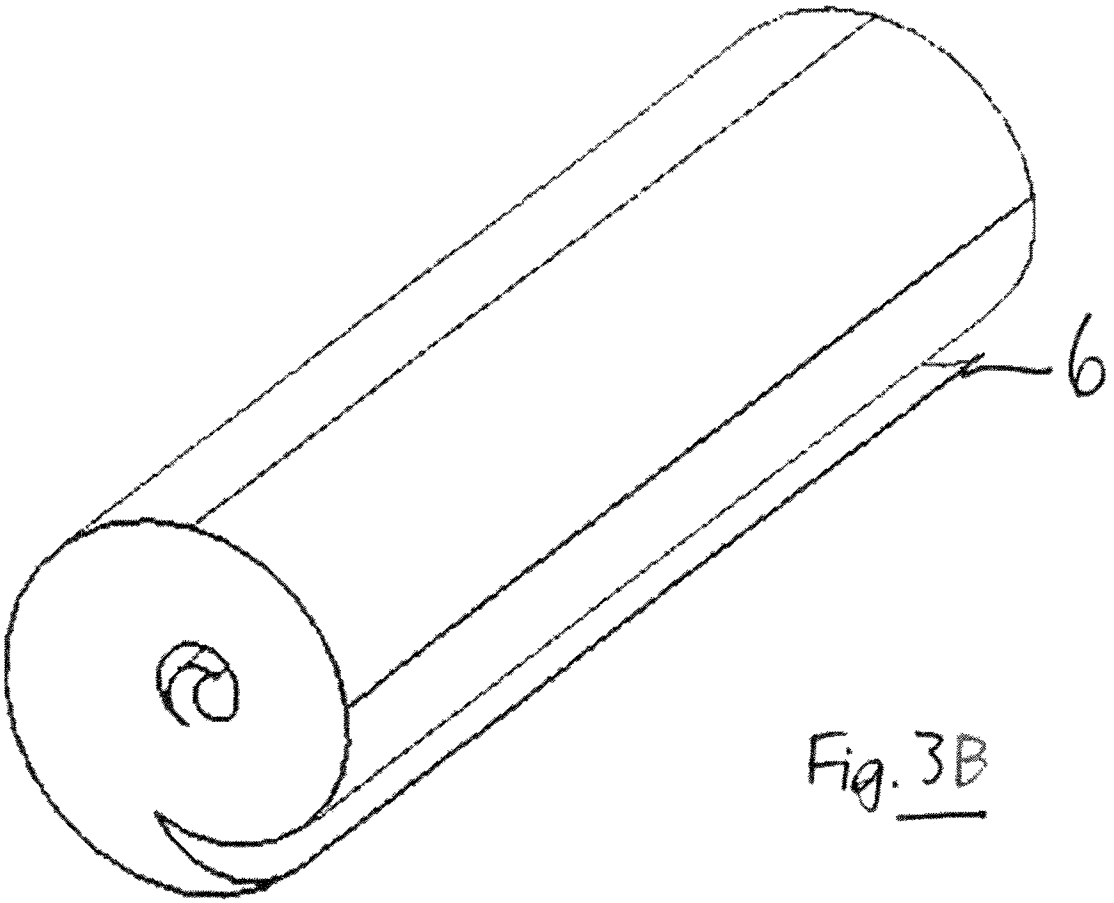

FIG. 3A shows a holder 1 to which an elastic cord 3 has been assembled. The holder 1 is provided with ribs R that serve a number of purposes, among which are imparting mechanical strength to the holder 1 and for aligning a rolled-up inflatable body (on which more later) properly within the holder so that upon inflating, the rolled-up inflatable body can unroll in an orderly and substantially straight manner. FIG. 3B shows the arrangement of FIG. 3A in which the inflatable body has been added (not shown) and the outer foil 6 that is rolled nearly but not quite fully around the holder. Incidentally, the axial ends of the holder can be used for signage, signalling, branding and the like.

Figure 4:
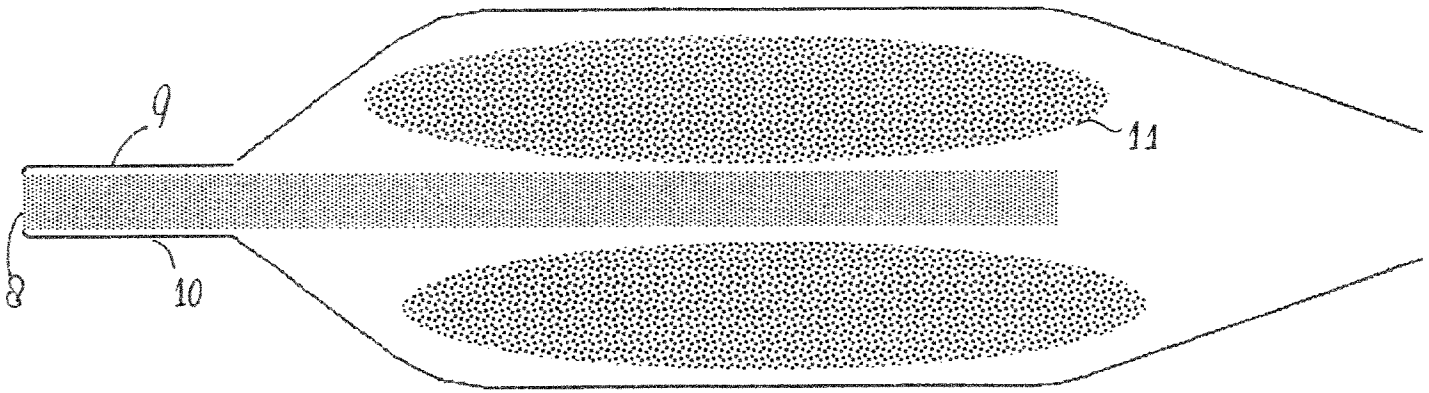
FIG. 4 shows a cross-sectional view of the narrow seal of the inflatable body.

FIG. 4 shows a cross-sectional view of the end of the inflatable body 5 that comprises a narrow seal. A strip of a non-woven material 8, e.g. Sontara® by Dupont, is shown as being layered between the two sides 9 and 10 of the inflatable body 5. The clouds schematically represent the gas-forming reagents 11 within the inflatable body.

Figure 5:
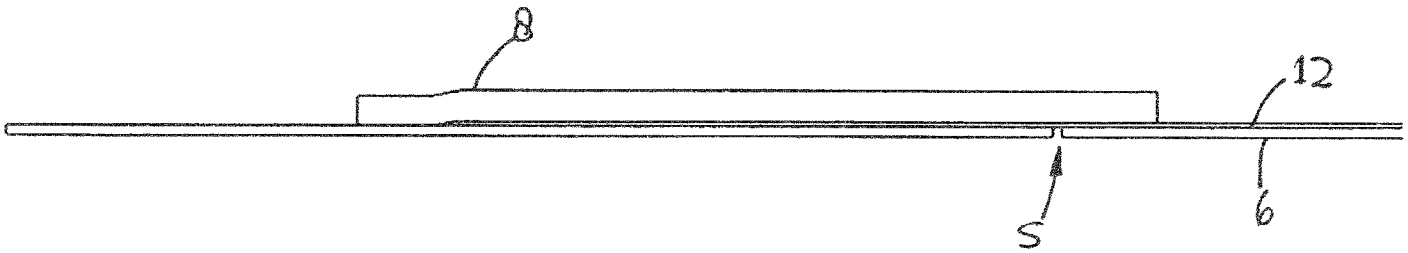
FIG. 5 shows a cross-sectional view of the arrangement of a spray water-resistant outer foil and a layer of non-woven material on its inside.

FIG. 5 shows a cross-sectional view of the arrangement of a spray water-resistant outer foil 6 and a layer of non-woven material 8 on its inside, with a strip of a water-soluble plastic 12, e.g. polyvinylalcohol, between these two. There is a small gap or slit S between the two edges of the outer foil 6.

Figure 6:
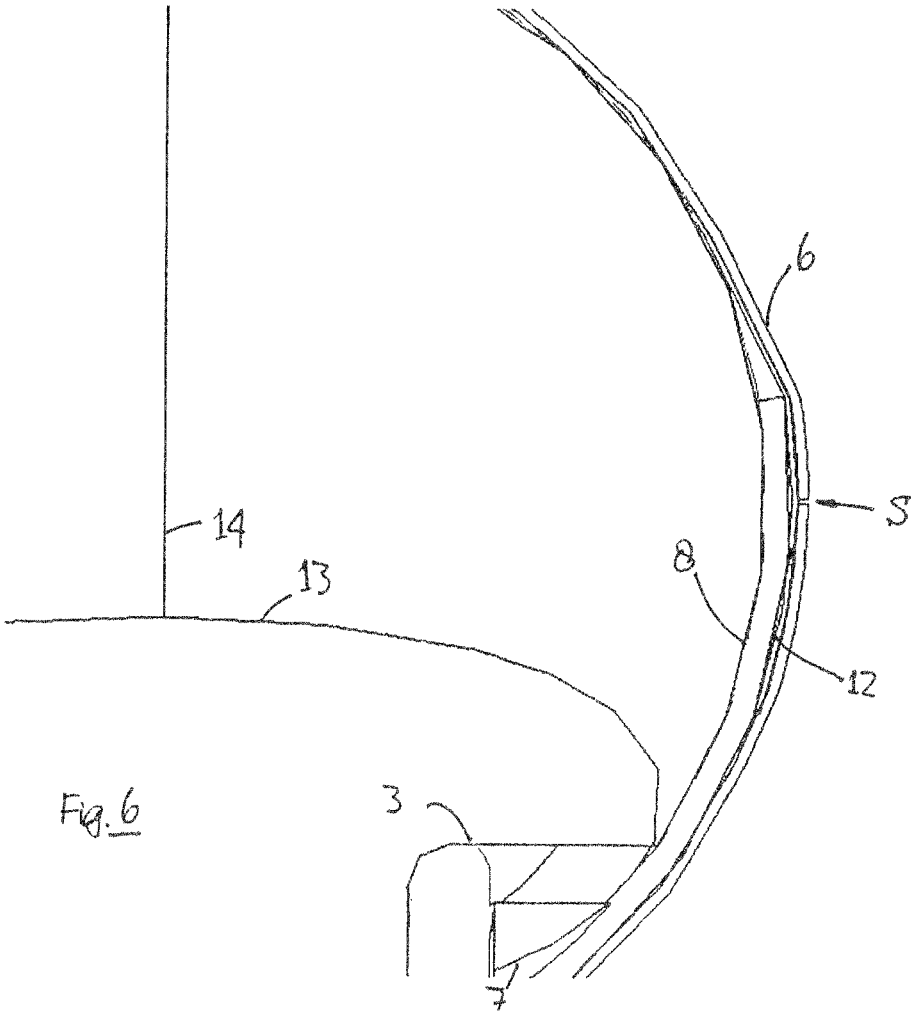
FIG. 6 shows the arrangement of FIG. 5 relative to a part of the flotation device in its ready-to-use state.

FIG. 6 shows the arrangement of FIG. 5 relative to a part of the flotation device in its ready-to-use state. The various reference numbers denote the same parts as in other drawings. The lines 13-14 schematically depict a section of the holder 1.

Figure 7:
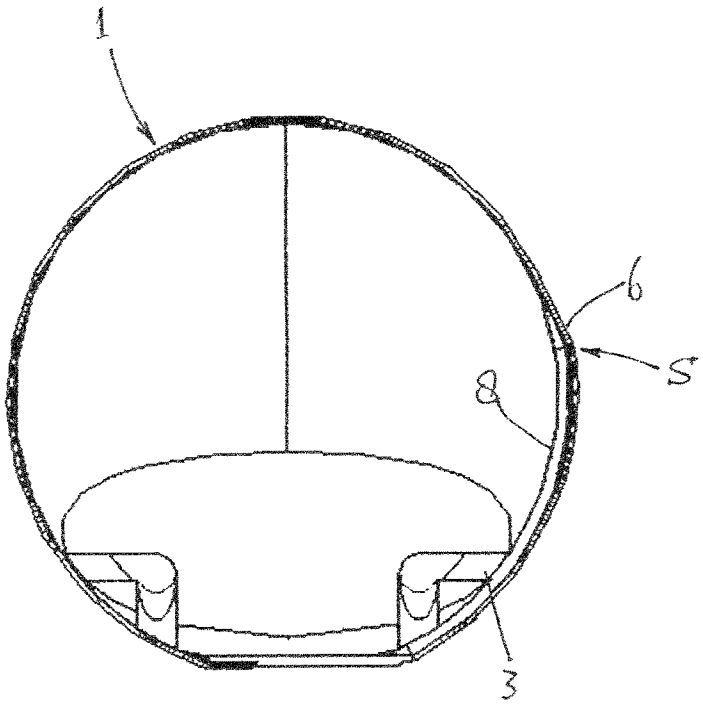
FIG. 7 shows the arrangement of FIG. 5 relative to the rest of the flotation device in its ready-to-use state.

FIG. 7 shows the arrangement of FIG. 5 relative to the rest of the flotation device in its ready-to-use state. The various reference numbers denote the same parts as in other drawings. The inflatable body is not shown.

Figure 8A:
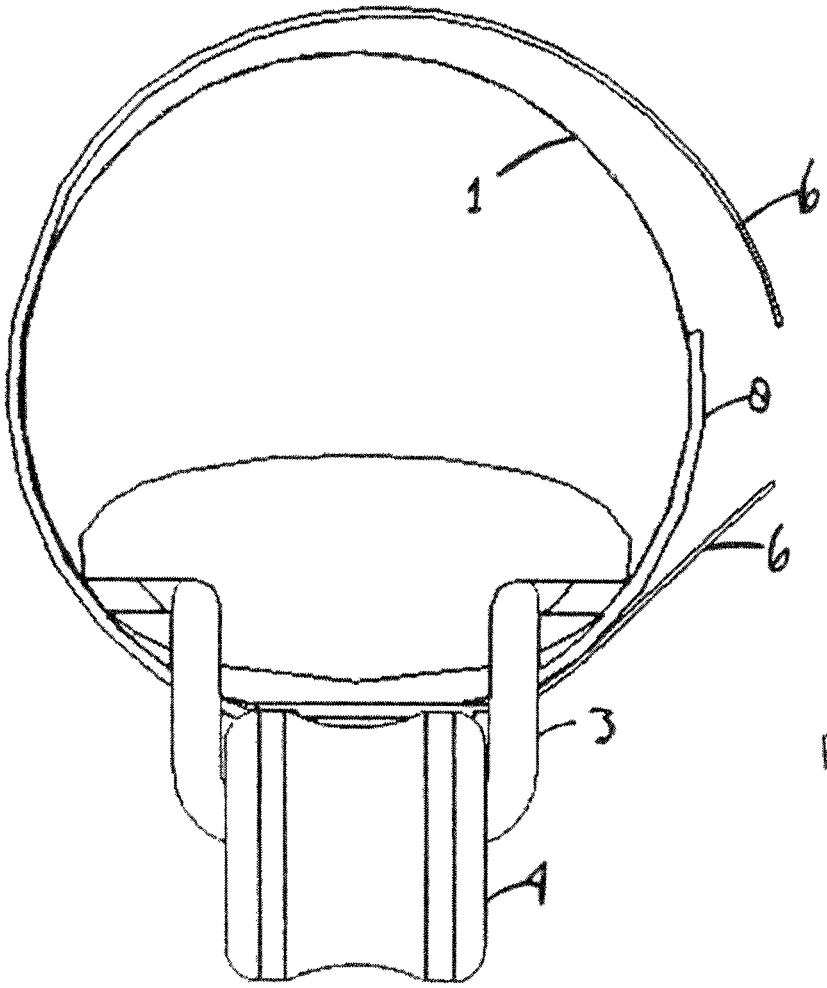
FIGS. 8A-8B show the arrangement according to FIG. 7 in a state in which the spray water-resistant foil is partly detached from the holder.
Figure 8B:
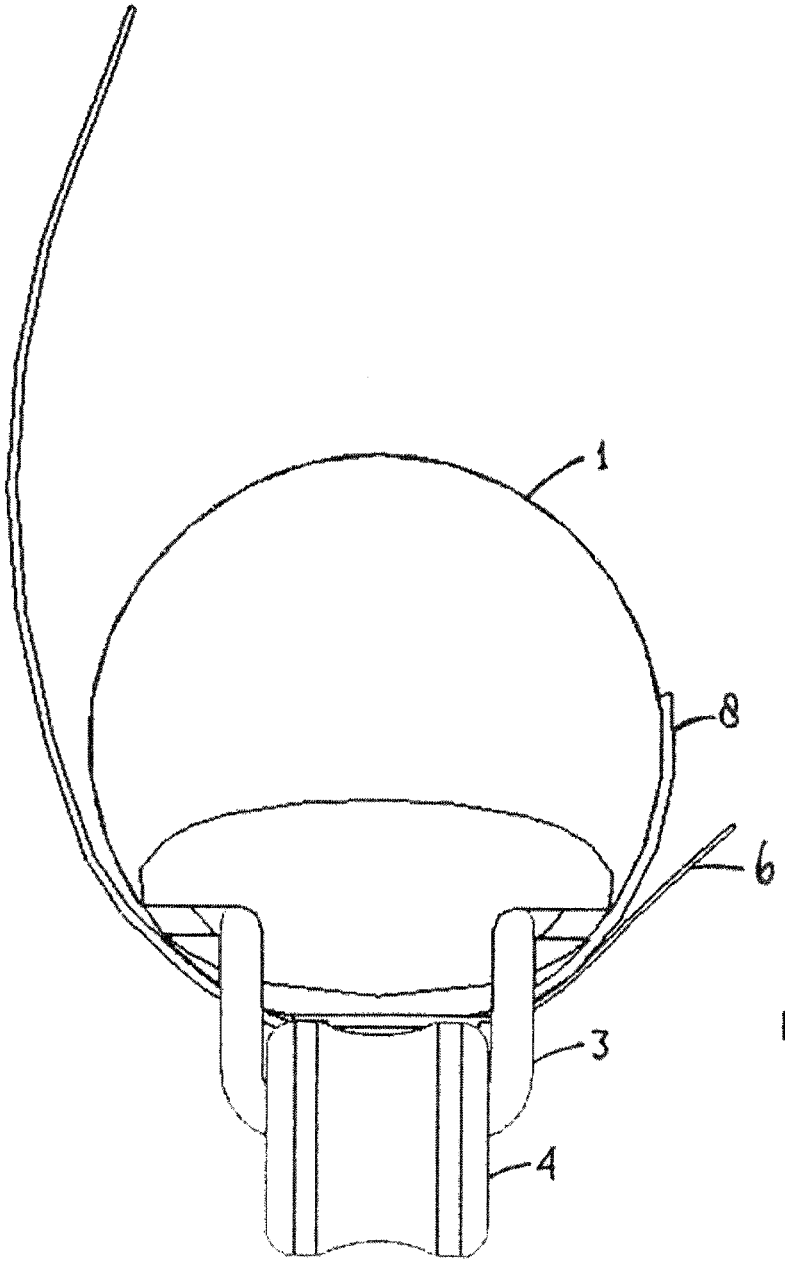
Figure 9:
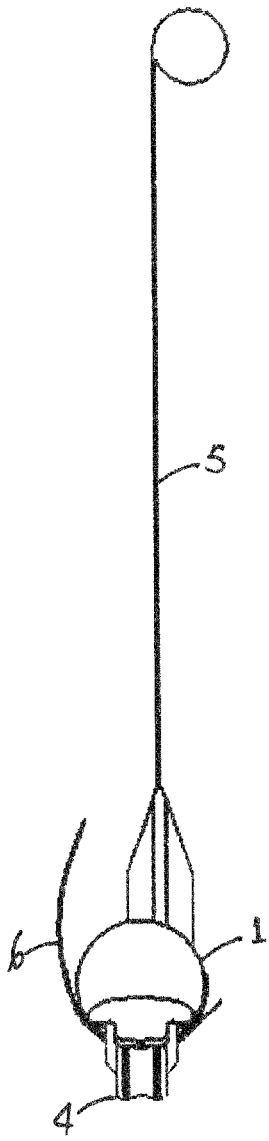
FIG. 9 shows the arrangement according to FIGS. 8A-8B whereby the inflatable body has been released at least in part from the holder and is in a state of being inflated.

FIGS. 8A-8B show the arrangement according to FIG. 7 in a state in which the water-soluble strip, e.g. a strip of polyvinylalcohol, has dissolved from within the holder. Since there is no longer any polyvinylalcohol holding the edges of the outer foil 6 together, one edge of foil is shown as being partly detached from the holder FIG. 9 shows the arrangement according to FIGS. 8A-8B whereby the inflatable body has been released at least in part from the holder and is in a state of being inflated.

The flotation device is assembled as follows. The PE tube is mounted on to the holder by any suitable conventional means, e.g. by the application of industrial-standard hot glue. A drop of glue is placed on the holder and a PE tube is pressed down on the drop of hot glue. The PE tube is pressed down at the side of its bottom end where the gas-forming reagents are held up. The drop of hot glue cools off very rapidly, resulting in a strong mechanical connection of the PE tube to the holder. Next, the PE tube is rolled up. Preferably, the top end of the roiled up PE tube is positioned on top of the section of the PE tube where the gas-forming reagents are accumulated, or as near to the top as possible, so that once the gas-forming reaction has started, the top end of the rolled-up PE tube can unroll as quickly as possible. Alternatively, the PE tube can be rolled up before it is attached to the PE tube by pressing it down on a drop of hot glue.

After the PE tube has been attached to the holder, the plastic foil is wrapped around the holder. It is important to ensure that the top end of the rolled up PE tube faces the incision in the plastic foil.

It is important to ensure that a rolled up PE tube is aligned carefully within the holder so that it can unroll easily. Notches, ribs and suchlike can be provided at the axial ends of the holder to ensure that a roiled-up PE tube unrolls evenly.

Once the sealed PE tube, the holder and the outer plastic foil have been assembled, the attachment means are brought into position. In the case of an elastic cord, the beads of the elastic cord are bent as shown in FIGS. 2-3. In the case of double-sided mounting tape, a strip of said type of tape can be mounted on an adhesive side onto the plastic foil while its other adhesive side can be left uncovered until the flotation device is attached to a retrievable object.

According to one embodiment according to the invention, the flotation device is cylinder-shaped, weighs about 2.7 g and has a length of 37 mm and a diameter of 10.3 mm. It comprises 0.5 g sodium bicarbonate and 0.5 g tartaric acid which afford a maximum lift weight of 60 g and a maximum depth of 20 m from which an object can be retrieved. When dropped in water, said embodiment of the flotation device typically takes 10-25 seconds to open. For an object weighing 40 g, a typical resurfacing time is 45 seconds.

The outer foil 6 is resistant in regard of at least spray water and atmospheric humidity. One or more of the outer surface areas of the holder may be of a decorative nature. One or more of these outer surface areas can be treated, for example for applying a signalling colour e.g. fluorescent orange or green, an image or a relief (logo). The holder 1, or at least one of its surfaces, can also be provided with means for locating positions, one example being a miniature transponder (not shown).

Regarding the attachment means: in the shown embodiment these means comprise two cylinder-shaped beads and an elastic cord that is covered with cloth. The cord forms a closed loop, e.g. by means of a knot tying the two ends of a length of cord. A cord that extends across the length of the holder is preferable because of the extent to which it can be elastically stretched. When a cord is mounted in or onto the holder, there is a certain amount of pre-tension or bias. This pre-tension ensures that the flotation device can be attached tightly enough to e.g. a pair of spectacles with very thin arms or very wide arms, since the elastic cord has a sufficiently long range of extension.

In regard of the inflatable body: in the shown embodiment this comprises a an extruded PE tube of e.g. 32.5 mm width and a length of 175 mm. This corresponds to a maximum volume of 60 milliliters. The PE tube is closed at its top end by means of any suitable seal. The PE tube is closed at its bottom end by means of a narrow seal as described above in relation to FIG. 4.

There are several methods of manufacturing an inflatable body that is suitable for use with the flotation device according to the invention. One method involves the steps of, among others, layering a strip of non-woven material between two separate layers of a substantially waterproof and gas-impervious material such as PE and sealing the three layers together, e.g. through the application of heat and/or pressure. Another method involves, among others, providing for a tube of a substantially waterproof and gas-impervious material such as PE, inserting a strip of a non-woven material, e.g. Sontara® by Dupont and preferably of the same width as the tube, at one end of the tube, melting the inserted strip and the tube together to form a narrow seal, preferably a double heat seal that melts the PE onto and into the non-woven material, providing for the gas-forming reagents within the tube and sealing the remaining open end. Many other so-called roll-to-roll methods of manufacturing can be envisaged that are equally suitable for the purpose at hand.

The double heat seal with the non-woven material serves a critical function. It acts as a valve that allows water to enter the PE tube but prevents the subsequently formed $CO_2$ gas, which results from the chemical reaction, from exiting the PE tube.

Another important function is that in the event of overpressure in the PE tube, e.g. when the PE tube rises rapidly from a great depth, the overpressure can be released through the valve. Otherwise the PE tube might burst and the $CO_2$ gas lost, so that the device and the object to which it is attached would sink.

In regard of the outer foil 6: in its assembled state the foil brings together three components: (a) a adhesive foil that is provided with an incision, (b) a substance that is rapidly dissolvable in water, e.g. a polyvinylalcohol (PVA), and (c) a water-absorbing non-woven material, e.g. Sontara®.

The function of the assembled foil is to hold the PE tube in its rolled-up state within the holder and to release it when the object to which the device is attached is dropped in water.

The foil can be assembled to its final state as follows. A piece of, preferably printable, adhesive foil is incised. The two sections of the piece are then mechanically joined by laminating a piece of PVA on the adhesive-covered side of the foil. The adhesive side of the foil is left uncovered at both ends of the foil. Next, a piece of water-absorbing non-woven material is mounted, covering the incision of the printable adhesive foil. Next, the edge of the foil near the non-woven strip is attached to the underside of the holder by sticking the adhesive side of the plastic foil onto the holder. Next, the foil is rolled around the cylindrical holder. The dimensions of the plastic foil are such that the length of the foil covers the circumference of the holder. The unlaminated adhesive edge of the plastic foil is then also stuck onto the underside of the holder. The result is that, as seen from outside of the holder towards its inside, there is a strip of plastic foil with its non-sticky side facing outside and its adhesive side on the inside and provided with an incision across its breadth, an underlying layer of PVA holding both sections of the PVA strip together and a layer of water-absorbing non-woven material on the inside of the PVA layer.

The incision in the plastic foil leaves a thin gap that is substantially resistant to splash water. Further resistance to splash water can be enhanced by applying a hydrophobic substance on the outside of the rolled-up plastic foil that encompasses the holder. This ensures that the flotation device only opens upon sufficient exposure to water, e.g. when it is actually dropped in water and not immediately retrieved. When a device lies in water, water reaches the water-absorbing non-woven material that is exposed at the axial edges of the rolled-up plastic foil. The non-woven material swells with water across the whole breadth of the holder underneath the incision and the water dissolves the PVA from within. The swelling of the non-woven material enhances the size of the gap in the plastic foil, thus making the plastic foil open even faster. In practice, the gap in the plastic foil opens in about 10-25 seconds after the device has been dropped in water.

After the plastic foil has opened, water can readily ingress into the holder and through the seal and come into contact with the gas-forming reagents comprised within the inflatable body. The gas-forming reaction is thus triggered and $CO_2$-gas is thus formed. The $CO_2$ inflates the inflatable body. The water-absorbing non-woven material, when wetted, attains an increased resistance to transport of mass across it, so that the formed $CO_2$ gas is retained within the inflating body.

It is important that the seal of the water-absorbing non-woven material in the PE tube is made such that there is no leak at all. In a preferred embodiment, the width of the seal is approx. 3-4 mm. The extent to which a seal is leakproof determines the force the enclosed PE tube can exert on the foil encasing it when the gas-forming reaction starts. The more force an inflating and unfolding PE tube can exert on the foil, the sooner the foil will break open to free up the PE tube. This aspect is important so that in the event that the device, after being dropped in water, comes to rest against another object, e.g. a pebble or rock at the bottom of a stream or lake, the unfolding and inflating of the PE tube will not be hampered by the pebble or rock as the PE tube will be able to exert an increasing force to push the foil and holder and the object to which the flotation device is attached away from the pebble or rock.

After the PE tube has unrolled out of the holder and the foil, the gas-forming process within the PE tube allows the PE tube to be inflated rapidly. When the volume within the PE tube exceeds the net weight of the retrievable object to which the flotation device is attached, then the retrievable object will start to rise towards the surface.

The net weight is defined as the weight of the retrievable object minus the volume of the retrievable object. For example, when a retrievable object is a pair of spectacles, a pair of spectacles typically weighs between 15 g and 40 g, with its net weight being approx. 50% of its actual weight. The PE tube is provided with a (inflatable) volume of 60 ml, so the maximum weight of the retrievable object (a pair of spectacles) can be 60 g. When a retrievable object is dropped in deep water, the water pressure will compress the $CO_2$ gas in the tube. In light of this aspect, a small excess amount of gas-forming reagents is used in order to generate a higher pressure than the minimum pressure required for flotation of the retrievable object. In the given example, one gram of 50% industrial grade sodium bicarbonate and 50% industrial grade tartaric acid is used to generate the $CO_2$ gas. This amount is sufficient to generate approx. 120 ml of $CO_2$. This means that a pair of spectacles weighing 40 g can be raised from a maximum depth of 20 m. At the surface, the pressure is 1 bar, so 40 ml of $CO_2$ is required to lift 40 g. At a depth of 20 m, the pressure is 3 bar, which entails 3×40 ml, thus 120 ml $CO_2$ to lift 40 g.

A pair of spectacles will sink at a typical rate of 0.4 m per second. This allows a period of (20 m/0.4 m/s), that is 50 seconds, in which the flotation device needs to open. This period of 50 seconds is ample given typical times of 10-25 seconds it takes for the flotation device to open.

Various aspects of the flotation device are now described in light of enablement.

Some examples of water-permeable substances that are suitable for application according to the invention, are—non-limitatively—: paper types that are strong when wet, fine-woven linen, substances comprising cellulose fibres or polyester fibres such as used for cleaning tissues. Also so-called "non-woven" matter is generally suitable for application according to the invention. "Non-woven" matter should understood to include fiber-comprising matter, that is not shaped in threads, and of which the fibres are mutually orientated in a particular direction, or otherwise are orientated at random, and which are bound to each other, such as by means of friction and/or cohesion and/or adhesion.

In a preferred embodiment the material of the substantially gas-impervious inflatable body has a predetermined-overpressure releasing function. An advantage hereof relates to the development that when the device sinks deeply in water and it thereby takes up sufficient water so that the gas-forming reaction occurs, as the propagating gas-forming reaction takes place a growing flotation force is exerted. The gas pressure in the inflated body will be equal to the pressure at the respective depth, and there will an equilibrium between the two. Due to the increasing pressure in the inflated body as a result of gas formation, the device in question will ascend towards the water surface. The difference between the increasing pressure in the inflated body and the decreasing water pressure on the inflated body as the device ascends, i.e. the overpressure within the inflated body, will keep on increasing. A possible explosion of the inflated body is thus prevented by an appropriate choice of the pressure value below which the inflated body needs to be kept.

In a preferred embodiment the material of the inflatable body comprises the substance which is commonly available under the trade name Sontara®. Sontara® is a plastic, supplied by Dupont, which also fulfills the two above-mentioned requirements in regard of absorbing water quickly and well and, when water has been absorbed, gaining closed pores in a substantial measure. In further embodiments, the substantially gas-impermeable inflatable body can comprise combinations of different water-permeable substances, either with or not in combination with plastics such as polypropene and polyethene.

It shall be clear that in principle any material that can allow water through well and quickly is suitable for use in the device according to the invention. It will suffice if a material that is wet becomes substantially air-impervious. It is preferable if the material obtains substantially closed pores once water is been taken up in the water-permeable substance. Other further desirable properties of the material are that the material, when wet, has sufficient mechanical strength, and that it can be folded or rolled compactly when in a dry state, and that it can be provided with a good sealing of a seam.

In a preferred embodiment the reagents are provided at the bottom end of the inflatable body. An advantage hereof is that the reagents required for the formation of gas are already into contact with each other and that these can react with each other immediately upon sufficient water having ingressing through the seal and into the inflatable body. If the object concerned falls in shallow water and it is collected quickly again, then there will be little opportunity for sufficient water ingressing through the holder en passing through the seal. Under these circumstances the flotation device will not be exposed sufficiently long to allow any water that may have ingressed through the axial ends of the foil and through the seal to trigger the gas-forming reaction within the inflatable body. Conversely, if the object concerned is not retrieved immediately, then sufficient water will enter the holder quickly enough allowing in the required flotation force to be exerted sufficiently quickly.

According to another aspect of the invention the mechanism for the opening of the spray water-resistant holder comprises at the inner surface of the holder a substance that is not soluble in humidity and soluble in water, such as e.g. a polyvinylalcohol. This substance can be in the form of, for example, an attachment layer that keeps two co-operating halves of an elongate device that are provided along its longitudinal direction, together till the device is dropped in water. This offers the advantage that the holder does not open due to the first (spats of) spray water, but that it opens first after the water-soluble attachment has dissolved along a sufficient length thereof and it releases the inflatable body encompassed in the holder.

In another embodiment the spray water-resistant holder comprises a water-soluble foil, preferably a bio-degradable plastic foil. This offers the advantage that the holder can be made environment-friendly. The water-soluble may additionally be laminated to a printable layer, so that the holder can be given a visually attractive appearance.

Preferably, the flotation device has an elongate shape. In principle, the device can be provided in any choice of shape that allows a large inflatable body to be provided in a compact state in the holder. For use of the device for saving a person, the device can be embodied in the form of a life jacket or another item of clothing, such as a T-shirt, shirt or pair of trousers. Here too the device can be provided in sections of the item of clothing, such as e.g. only in the collar. The advantage of providing the device in a life jacket or an item of clothing is that as long as the person is not in water, the life jacket or item of clothing stays uninflated and thin and that it thus can be worn with a certain measure of freedom of movement and (measure of) comfort. An item of clothing hereby does not necessarily have to be provided with the device according to the invention on the whole of its surface. Under certain circumstances it could suffice to provide a number of parts with the device, such as the collar and/or the sleeves of a shirt.

The flotation device according to the invention can be used for retrieving lightweight objects such as pairs of spectacles and cell phones, medium-weight objects such as wallets, and also heavyweight objects weighing up to tens of kilograms. The flotation device can be formed as a cluster of devices, e.g. a large-sized holder comprising several small-sized flotation devices which are released from a cluster only under certain circumstances and which can be inflated only thereafter in order to keep a heavy object afloat.

Two insights on which the above-described invention is based, are the fast release of an inflatable body provided in a compact state when a certain threshold value of wetting of the device is exceeded, and the use of a narrow seal with the inflatable body for a fast activation of a gas-forming reaction that is required for the flotation or driving force which is to be exerted. There are numerous possible uses and embodiments imaginable which are considered to fall within the scope of the above-described invention.

The invention claimed is:

1. A flotation device for use in retrieving an object when dropped in water comprising:

an attachment assembly to attach the flotation device to an object that is to be retrieved, a spray water-resistant holder having closed and opened conditions and an interior which defines an interior space;

an inflatable body formed of a tubular substantially waterproof and air-impervious material having opposed ends, the inflatable body being attached to the interior of the holder and positioned in the interior space of the holder in a non-inflated state thereof, wherein inflation of the inflatable body from the non-inflated state and into an inflated state thereof responsively causes the holder to be opened from the closed condition to the opened condition thereof so as to allow the inflatable body to be deployed outside the interior space of the holder, wherein the inflatable body includes:

(a) a seal comprising a strip of water-permeable material sandwiched between and joined directly to opposed sections at one of the ends of the inflatable body for sealing the inflatable body from the interior space of the holder, wherein the strip of water-permeable material of the seal has an end portion exposed to the interior space of the holder to thereby allow water ingress into the inflatable body through the exposed end portion of the strip of water-permeable material of the seal in response to water ingress into the interior space of the holder, and (b) one or more reagents contained within the inflatable body which react to form a gas under the influence of water that ingresses into the interior space of the holder and through the water-permeable material of the holder at the end of the inflatable body, wherein the gas inflates the inflatable body into the inflated state thereof in order to exert a flotation force on the object to which the device is attached.

2. The flotation device according to claim 1, wherein the seal comprises a single layer of the water-permeable material sandwiched between and joined to the opposed sections of the inflatable body.

3. The flotation device according to claim 1, wherein the seal has a cross-section which is more narrow than a cross-section of the inflatable body.

4. The flotation device according to claim 3, wherein the seal has a cross-sectional dimension which measures between 0.2 mm and 200 mm.

5. The flotation device according to claim 3, wherein the seal extends into the inflatable body in a direction perpendicular to the cross-section of the seal by a length that is 0.3-30 times the cross-sectional dimension of the seal.

6. The flotation device according to claim 3, wherein the holder has a cylindrical shape.

7. The flotation device according to claim 1, wherein axial ends of the holder include elements for keeping the inflatable body away from opposed axial ends of the holder.

8. The flotation device according to claim 1, wherein the water-permeable material of the seal of the inflatable body is water-absorbing.

9. The flotation device according to claim 1, wherein the water-permeable material of the seal is a hydrophilic material.

10. The flotation device according to claim 1, wherein the water-permeable material of the seal of the inflatable body is capable of releasing a predetermined overpressure within the inflatable body.

11. The flotation device according to claim 1, wherein the water-permeable material of the seal of the inflatable body comprises a non-woven material.

12. The flotation device according to claim 11, wherein the non-woven material is capable of drawing and absorbing water.

13. The flotation device according to claim 1, wherein the strip of water-permeable material comprises a strip of a non-woven material, and wherein the opposed sections at one end of the inflatable body are double heat sealed to the strip of the non-woven material such that the substantially waterproof and air-impervious material of the inflatable body at the one end thereof has melted locally on and into the strip of non-woven material.

14. The flotation device according to claim 1, wherein at least a part of the inflatable body comprises plastic material selected from the group consisting of polypropene and polyethene.

15. The flotation device according to claim 1, wherein the inflatable body comprises a single compartment.

16. The flotation device according to claim 1, wherein the one or more reagents is distributed at a plurality of locations within the inflatable body such that a gas-forming reaction by the one or more reagents occurs at more than one location within the inflatable body.

17. A flotation device for use in retrieving an object when dropped in water comprising:

an attachment assembly to attach the flotation device to an object that is to be retrieved, an inflatable body formed of a substantially waterproof and air-impervious material;

a spray water-resistant holder having closed and opened conditions, wherein the holder includes an interior which defines an interior space encompassing the inflatable body when the holder is in the closed condition, and wherein the holder is capable of being opened from the closed condition to the opened condition so as to allow the inflatable body to be deployed outside the interior space of the holder, wherein the inflatable body includes:

(a) a seal comprising a water-permeable material joined directly to the inflatable body for sealing the inflatable body from the interior of the holder, and (b) one or more reagents contained within the inflatable body which react under the influence of water that ingresses into the interior of the holder through the water-permeable material to form a gas, which gas serves to inflate the inflatable body in order to exert a flotation force on the object to which the device is attached, and wherein the holder comprises an amount of a non-woven water-absorbing material which swells in response to contact with water to assist in opening of the holder from the closed condition to the opened condition of the holder.

18. The flotation device according to claim 17, wherein the non-woven water-absorbing material is capable of drawing and absorbing water.

19. The flotation device according to claim 17, wherein the holder further includes a water-resistant foil having a slit or gap across at least a part of an axial length of the foil.

20. The flotation device according to claim 19, wherein the foil is positioned on the holder so as to be exposed to environmental elements, wherein the foil is formed of a material that is soluble in water but insoluble in humidity.

21. The flotation device according to claim 19, wherein the water-soluble foil is a bio-degradable plastic foil.

22. The flotation device according to claim 21, wherein the water-soluble foil is provided with a printable surface.

23. The flotation device according to claim 1, wherein the attachment assembly comprises an elastic cord.

24. The flotation device according to claim 23, wherein the elastic cord is covered by a material capable of sliding along an object.

25. The flotation device according to claim 1, wherein the attachment assembly comprises tape.

26. The flotation device according to claim 25, wherein the tape is a double-sided mounting tape.

27. A method for manufacturing a flotation device according to claim 1 comprising, whereby the method comprises the following steps:

(a) inserting a layer of non-woven material at one end of a length of an open-ended tube, (b) applying heat and/or pressure for melting one end the tube and the non-woven material together to thereby form a seal at the one end of the tube, (c) providing said length of tube with gas-forming reagents from a remaining open end of the tube opposite to the one closed end of the tube, (d) extracting air within the length of the tube, and sealing off the remaining open end of the tube to form an inflatable body, (e) rolling up the length of tube in the direction of the seal, (f) attaching the rolled-up inflatable body to a holder, (g) providing a spray water-resistant foil around the housing that comprises the rolled-up inflatable body to form an inflatable assembly, and (h) providing an attachment assembly to the inflatable assembly comprised of the spray water-resistant foil encompassing the holder, which in turn encompasses the inflatable body comprising the seal and the gas-forming reagents therewithin, to thereby form the flotation device, the attachment assembly allowing attachment of the flotation device to an object that is to be retrieved when the flotation device is dropped in water.

* * * * *